US006853349B1

(12) United States Patent
Chishinski

(10) Patent No.: US 6,853,349 B1
(45) Date of Patent: Feb. 8, 2005

(54) METHOD AND DEVICE FOR PREVENTION OF GIMBAL-LOCKING

(75) Inventor: Ehud Chishinski, Nofit (IL)

(73) Assignee: Rafael-Armament Development Authority LTD, Haifa (IL)

( * ) Notice: Subject to any disclaimer, the term of this patent is extended or adjusted under 35 U.S.C. 154(b) by 119 days.

(21) Appl. No.: 10/367,895

(22) Filed: Feb. 19, 2003

(30) Foreign Application Priority Data

Feb. 28, 2002 (IL) ..... 148452

(51) Int. Cl.[7] ..... H01Q 3/00

(52) U.S. Cl. ..... 343/882; 343/766; 343/765; 343/763; 343/757

(58) Field of Search ..... 343/882, 766, 343/765, 763, 757, 758, 761

(56) References Cited

U.S. PATENT DOCUMENTS

| | | | | |
|---|---|---|---|---|
| 2,968,997 A | | 1/1961 | Newton, Jr. et al. | 89/41.02 |
| 4,907,009 A | * | 3/1990 | Pinson | 343/766 |
| 5,512,912 A | * | 4/1996 | Ross et al. | 343/882 |
| 5,594,460 A | * | 1/1997 | Eguchi | 343/765 |
| 6,023,247 A | * | 2/2000 | Rodeffer | 343/882 |
| 6,262,687 B1 | * | 7/2001 | Bai et al. | 343/763 |
| 6,285,338 B1 | | 9/2001 | Bai et al. | 343/882 |
| 6,577,281 B2 | * | 6/2003 | Yamamoto et al. | 343/766 |

FOREIGN PATENT DOCUMENTS

| | | |
|---|---|---|
| EP | 0111192 | 6/1984 |
| EP | 0383043 | 8/1990 |
| EP | 1120624 | 8/2001 |
| WO | WO88/08952 | 11/1988 |

* cited by examiner

*Primary Examiner*—Hoang V. Nguyen
*Assistant Examiner*—Ephrem Alemu
(74) *Attorney, Agent, or Firm*—Mark M. Friedman

(57) ABSTRACT

A device for aiming a directional device, such as a beam transmitter, mounted on a platform having a platform roll axis, the device having a device roll axis and a device nod axis, wherein the device roll axis is substantially different from the platform roll axis. Also a method for aiming a directional device, such as a beam transmitter, mounted on a platform having a platform roll axis by providing a device of the present invention, aiming the directional device by changing the aim of the directional device about the device roll axis and about the device nod axis; and, if as a result the device roll axis approaches coincidence with the aimed direction, rotating the platform about the platform roll axis.

16 Claims, 9 Drawing Sheets

METHOD AND DEVICE FOR PREVENTION OF GIMBAL-LOCKING

FIELD AND BACKGROUND OF THE INVENTION

The present invention relates to the field of beam steering, and more specifically, to a method and a device that prevent gimbal-locking of gimbal mounts and related beam-steering devices.

In many fields it is necessary to mount a directional device on a platform so as to allow the directional device to be oriented independently of platform orientation. A device that has proven exceptionally useful for this task is the gimbal mount. A gimbal mount is basically a mounting frame having two orthogonal axes of rotation. In FIG. 1, a typical gimbal mount 10 is depicted, where a telescope 12 is mounted to a platform 14 (in FIG. 1, a raft). Telescope 12 is directly mounted to a moveable nod ring 16 that is mounted on a moveable roll ring 18, connected to platform 14. The orientation of telescope 12 can be changed by movement around nod axis 20 and around gimbal roll axis 22 of gimbal mount 10. As a result, telescope 12 can be oriented without being influenced by the orientation of platform 14.

One specific application where gimbal mounts are used is to mount a directional seeker (e.g. infrared, UV/vis) to the nose of a projectile (e.g. missile, smart-bomb, cannon/artillery shell and the such) or to track satellites using a radio-frequency antenna. In FIG. 2A, a gimbal mount 24 is used to allow seeker 26 of a projectile 28 with transparent nose cover 29 to be oriented in the direction of a moving target 32, while the relative position of moving target 32 and projectile 28 changes. Gimbal mount 24 has two rotatable axes, gimbal nod axis 34 and gimbal roll axis 36.

A serious shortcoming of a gimbal mount such as 24 occurs when the directional device, such as seeker 26, needs be directed at or in proximity of a direction 30 which is close to colinear to gimbal roll axis 36, FIG. 2B. In order for seeker 26 to remain directed at moving target 32 passing at or near direction 30, gimbal roll axis 36 must rotate quickly requiring an extremely high, often unattainable, rotational acceleration. This problem is called gimbal locking or as the keyhole problem.

The nature of the problem of gimbal locking has been fully described in U.S. Pat. No. 6,285,338, which is incorporated by reference for all purposes as if fully set forth herein. Specifically, FIG. 13 of U.S. Pat. No. 6,285,338 and the accompanying description discuss the angular speed required to track a target moving near or through a direction which is colinear with the gimbal roll axis.

To change the orientation of the directional device at a given speed, the closer the gimbal roll axis is to colinearity with the direction vector the faster the gimbal roll axis must move. In FIG. 13 of U.S. Pat. No. 6,285,338, to track a given satellite using a gimbal mounted radar antenna (the directional device), a 5° divergence requires an angular rotation of 1° $sec^{-1}$. To track the same satellite, a 1° divergence requires an angular rotation of 4° $sec^{-1}$ and a 0.1° divergence requires an angular rotation of 12° $sec^{-1}$.

One method to overcome the problem of gimbal locking is to provide a massive gimbal mount equipped with powerful motors. For projectiles, where weight and size allowances are at a premium and, due to the disposable nature of projectiles, price reduction an advantage, this is at best an academic solution. Further, it is generally preferred that high accuracy gimbal mounts be lightweight to avoid problems associated with large moments of rotation.

Another method to overcome the problem of gimbal locking is taught in U.S. Pat. No. 6,285,338. A device is provided to reorient, by tilting, the directional device relative to the gimbal mount when a gimbal locking situation is approached. In a situation where a standard gimbal mount would have to direct a directional device with, for example, a 0.1° divergence of the gimbal roll axis from the direction vector, a gimbal mount according to the teachings of U.S. Pat. No. 6,285,338 tilts the antenna by, for example, 0.9° in an appropriate direction. This tilting reduces the magnitude of angular rotation necessary for tracking threefold. Although effective, a mechanism such as taught by U.S. Pat. No. 6,285,338 adds a level of mechanical complexity, weight and expense to a gimbal mount that often makes such a mechanism unsuitable for use in a platform, such as a projectile, where space, weight and cost are important factors.

There is a need for a lightweight and simple method to avoid gimbal locking, especially for mounting a directional device in a projectile.

As is clear to one skilled in the art, gimbal locking is not a problem unique to actual gimbal mounts, but also to related beam steering devices. Other beam steering devices shall be discussed in more detail hereinbelow. It is important to note, however, that the term "gimbal-locking" is hereinafter used to refer to actual gimbal locking of a gimbal mount as well as to the analogous problem of related beam steering devices. The description and discussion of the present invention herein will refer primarily to an actual gimbal mount rather then the more general beam-steering device. This is done exclusively for purposes of clarity and is non-limiting to the scope of the description and of the claims herein. Perusal of the description of the present invention as herein set forth allows application of the present invention to beam-steering devices other than gimbal-mounts to one of average skill in the art.

SUMMARY OF THE INVENTION

According to the teachings of the present invention there is provided for a gimbal mount for aiming a directional device mounted on a platform, the platform having a platform roll axis including:

a) a gimbal structure for supporting the directional device, the gimbal structure including a gimbal roll axis and a gimbal nod axis, where the gimbal roll axis of the gimbal structure is substantially different from (neither coincident nor colinear) with the platform roll axis;

b) a first mechanism for changing the orientation of the directional device by rotation around the gimbal roll axis;

c) a second mechanism for changing the orientation of the directional device by rotation around the gimbal nod axis;

d) a roll-control device for causing rotation of the platform around the platform roll axis; and e) a device for controlling the first mechanism, the second mechanism and the roll-control device so as to coordinate rotation around the gimbal roll axis, the gimbal nod axis and the platform roll axis.

There is also provided according to the teachings of the present invention a device for steering a beam to or from a directional device mounted on a platform, the platform having a platform roll axis including:

a) a beam steering structure for steering the beam, the beam steering structure including a beam steering roll axis and a beam steering nod axis, wherein the beam steering roll axis is substantially different from (neither coincident nor colinear) with the platform roll axis;

b) a first mechanism for changing the orientation of the beam around the roll axis;

c) a second mechanism for changing the orientation of the beam around the nod axis;

d) a roll-control mechanism for causing rotation of the platform around the platform roll axis; and e) a device for controlling the first mechanism, the second mechanism and the roll-control mechanism so as to coordinate rotation around the beam steering roll axis, the beam steering nod axis and the platform roll axis.

There is also provided according to the teachings of the present invention a method of aiming a directional device, mounted on a platform having a platform roll axis, in a certain direction by:

a) providing a structure for aiming the directional device, the structure having a device roll axis and a device nod axis, wherein the device roll axis is substantially different from the platform roll axis;

b) aiming the directional device in the certain direction by changing the aim of the directional device about the device roll axis and about the device nod axis; and c) if as a result of aiming the directional device in the certain direction the device roll axis approaches coincidence with the certain direction (a gimbal locking situation) then the platform is rotated about the platform roll axis.

As used herein, the term "directional device" refers to any device with a highly directed mode of action. Such devices include devices configured to detect electromagnetic radiation such as directional passive radar antennae, detectors, seekers and cameras operative in the IR, UV and visible spectrum range. Such devices also include devices configured to project a beam of electromagnetic radiation such as directional active radar antennae, spotlights and lasers. Such devices also include projectors of solid objects such as rocket launchers and machine guns. As the present invention is directed to solving the problem of gimbal locking, it is clear to one skilled in the art that the present invention is more useful for directional devices with a narrow field of view (or action) then for directional device with a wide field of view (or action).

BRIEF DESCRIPTION OF THE DRAWINGS

The invention is herein described, by way of example only, with reference to the accompanying drawings, where.

DESCRIPTION OF THE PREFERRED EMBODIMENTS

According to the teachings of the present invention, a gimbal mount, as described in the prior art, is used to attach a directional device to a platform. In other embodiments of the present invention, a beam-steering device, as described in the prior art, is used to direct a beam to or from a directional device mounted on a platform. The platform is most often an aerial vehicle, especially a projectile. By projectile is meant a platform such as a missile, a rocket, a "smart-bomb", barrel-launched shell and the like. Unlike in the prior art, the gimbal mount or beam-steering device is attached to the platform so that the roll axis of the gimbal mount or beam-steering device is not colinear, preferably not parallel, to the platform roll axis. Further, the control system of the gimbal mount or beam steering device, in addition to the prior art configuration of directing the nod and roll axes of the gimbal mount or beam steering device, is also configured to control rolling of the platform around the platform roll axis when necessary, as described hereinbelow. The combination of two ideas, a) lack of colinearity between the platform roll axis and the gimbal mount or beam steering roll axis and b) control of platform rotation around the platform roll axis by the gimbal mount or beam steering device control system, allows gimbal locking to be avoided.

The principles and operation of the present invention may be better understood with reference to the drawings and the accompanying description.

Figure 1:
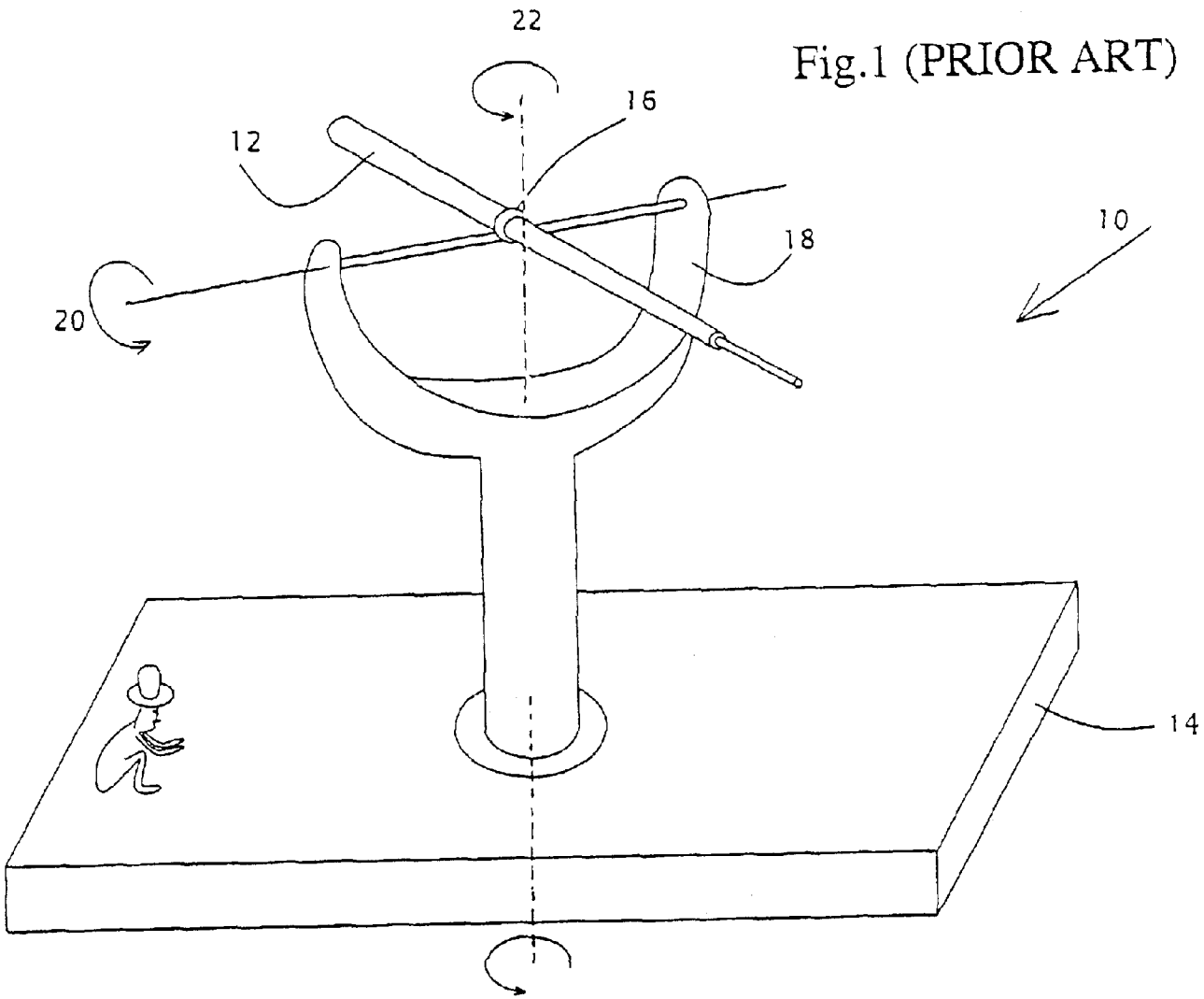
Fig.1 (PRIOR ART)
FIG. 1 (prior art) is a schematic depiction of a gimbal-mounted telescope on a raft.
Figure 2A:
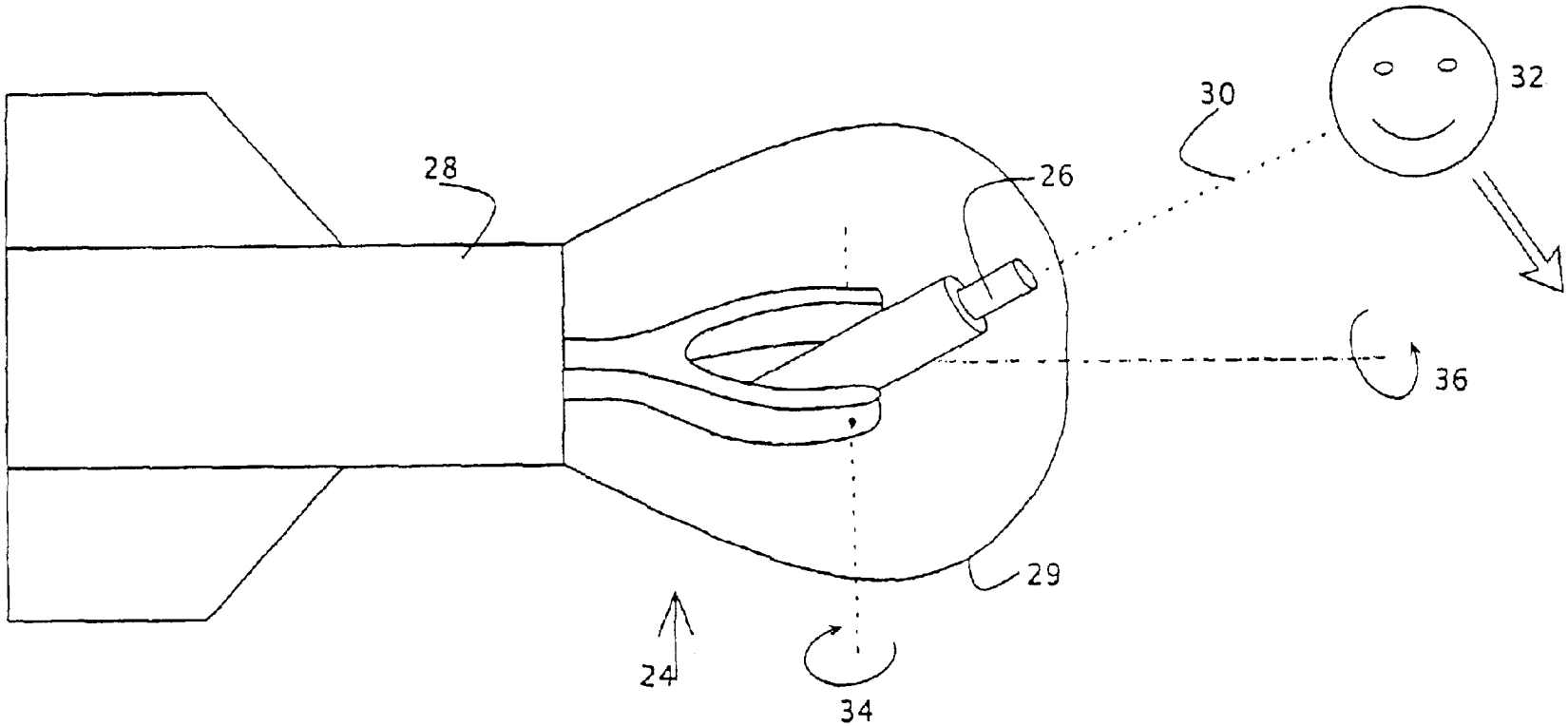
Fig.2A (PRIOR ART)
FIGS. 2A–2B (prior art) are a schematic depiction of a gimbal-mounted seeker on a platform.
Figure 2B:
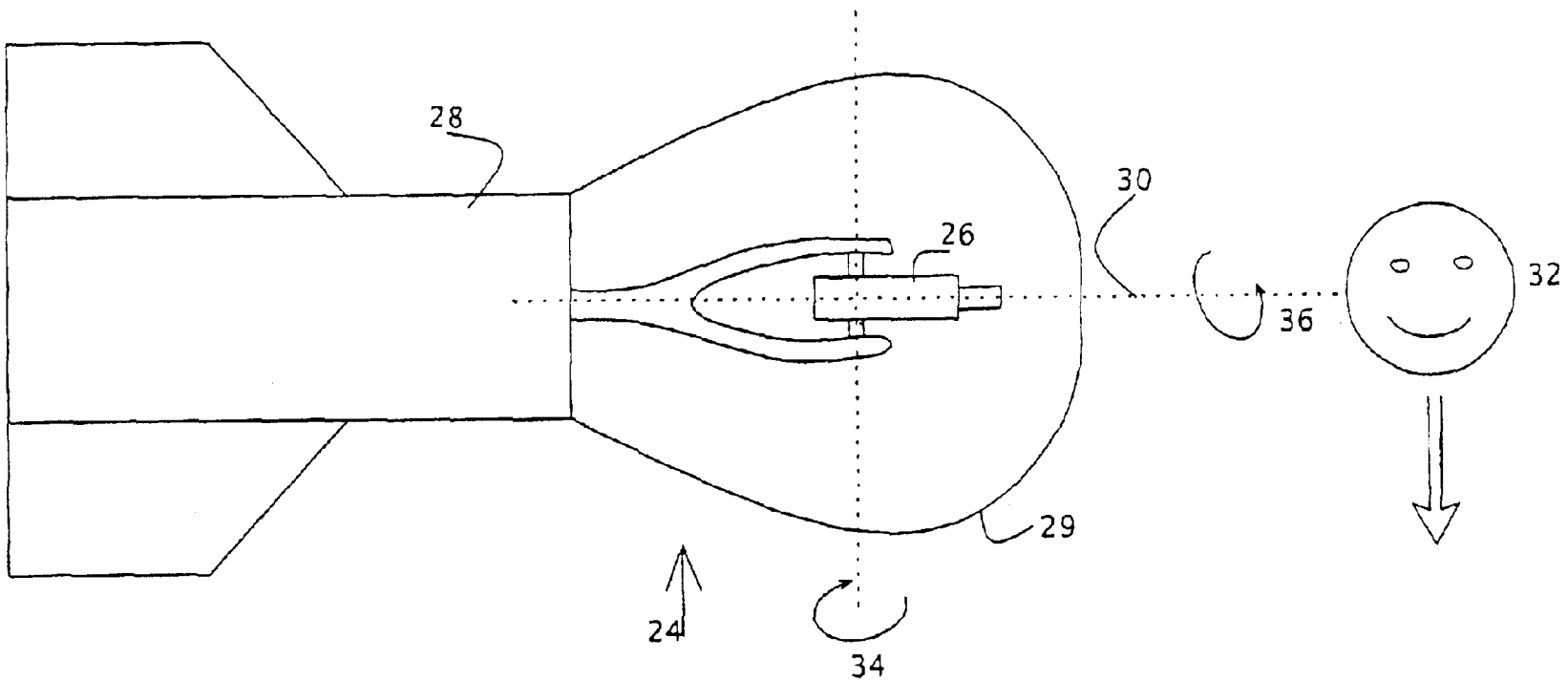
Fig.2B (PRIOR ART)
Figure 3A:
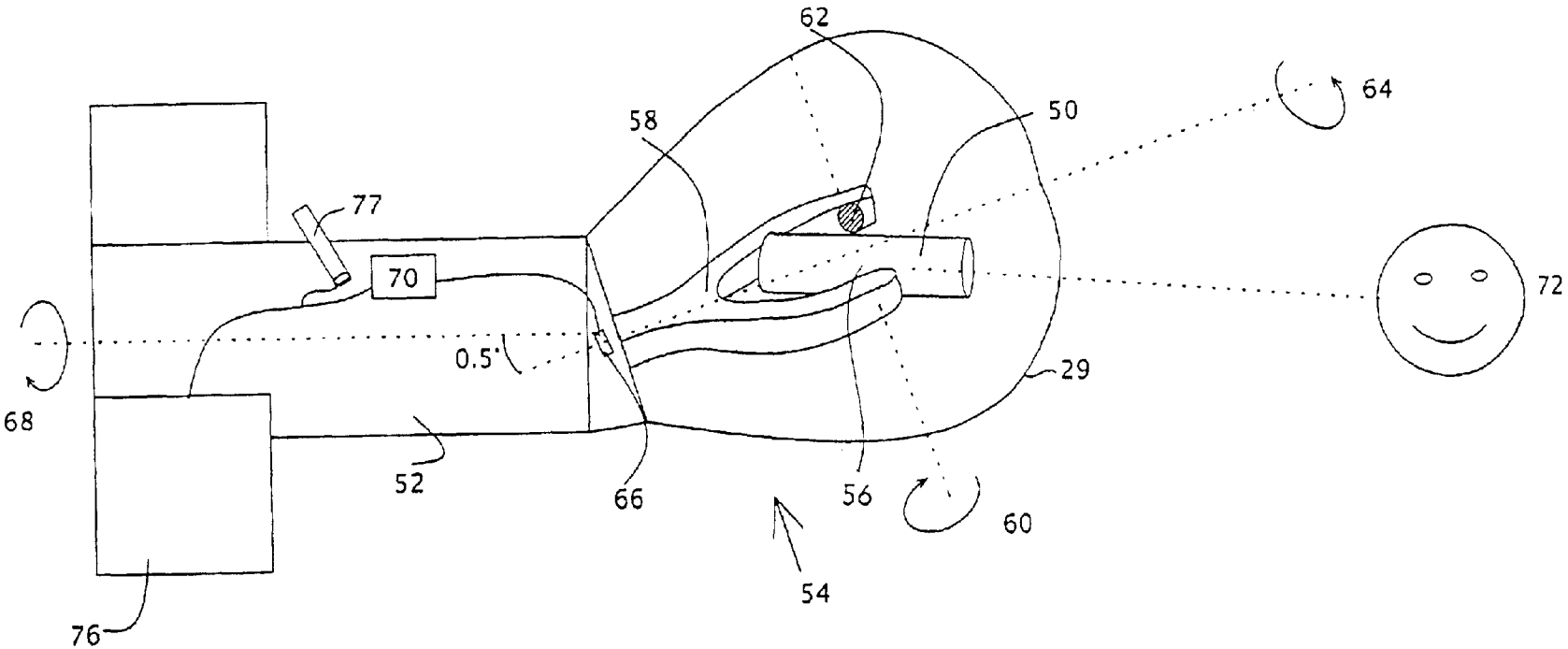
FIGS. 3A–3C are schematic depictions of a gimbal mount according to the method of the present invention where the gimbal roll axis is 0.5° divergent from the roll axis of the platform.
Figure 3C:
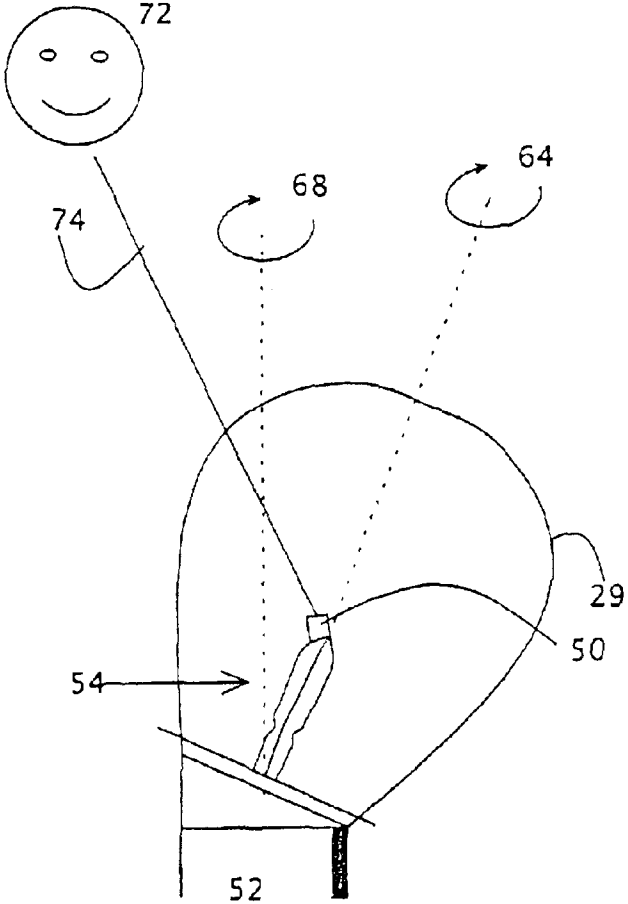
Figure 3B:
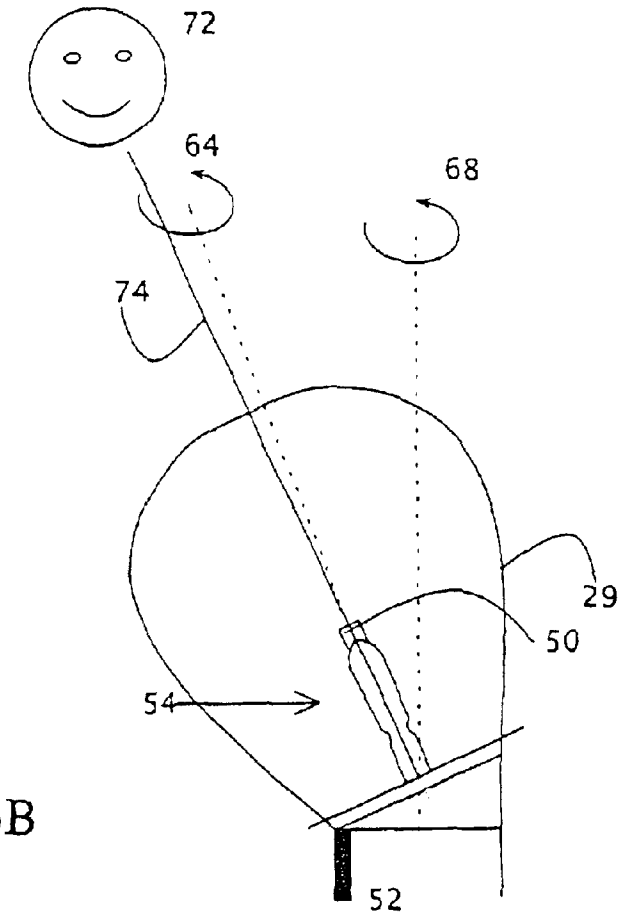

A first embodiment of the present invention is schematically depicted in FIGS. 3A through 3C where the gimbal roll axis is 0.5° divergent from the platform roll axis. A camera 50 is mounted on a platform 52 using gimbal mount 54. Gimbal mount 54 has two independently moveable members, nod member 56 and roll member 58. Camera 50 is connected to nod member 56, allowing rotation of camera 50 around gimbal nod axis 60 by activation of a first motor 62. Nod member 56 is connected to roll member 58, allowing rotation of camera 50 around gimbal roll axis 64 by activation of a second motor 66. Gimbal mount 54 is mounted on platform 52 so that gimbal roll axis 64 is 0.5° divergent from platform roll axis 68. The angular divergence of gimbal roll axis 64 from platform roll axis 68 in FIGS. 3A–3C has been exaggerated for illustrational clarity. As in prior art gimbal mounts, control system 70 is configured to activate first motor 62 and second motor 66 so as to direct camera 50 in a desired direction. Further, control system 70 is also configured to control rotation of platform 52 around platform roll axis 68.

In FIG. 3B, it is necessary to direct camera 50 at moving target 72 in a direction 74 that is close to a gimbal locking situation, e.g. a 0.1° divergence of gimbal roll axis 64 from direction 74. Control system 70 uses either aerodynamic surfaces 76 or an impulse motor 77 to rotate platform 52 around platform roll axis 68.

As a result of a 180° rotation of platform 52 around platform roll axis 68 relative to FIG. 3B, FIG. 3C, gimbal locking is avoided. In FIG. 3C, to orient camera 50 at moving target 72, a 1.1° divergence of gimbal roll axis 64 from direction 74 is necessary.

In FIGS. 3A through 3C, gimbal roll axis 64 is 0.5° divergent from platform roll axis 68. According to the method of the present invention, the exact magnitude of the divergence between gimbal roll axis 64 and platform roll axis 68 is not important and is decided based on engineering parameters.

Figure 4A:
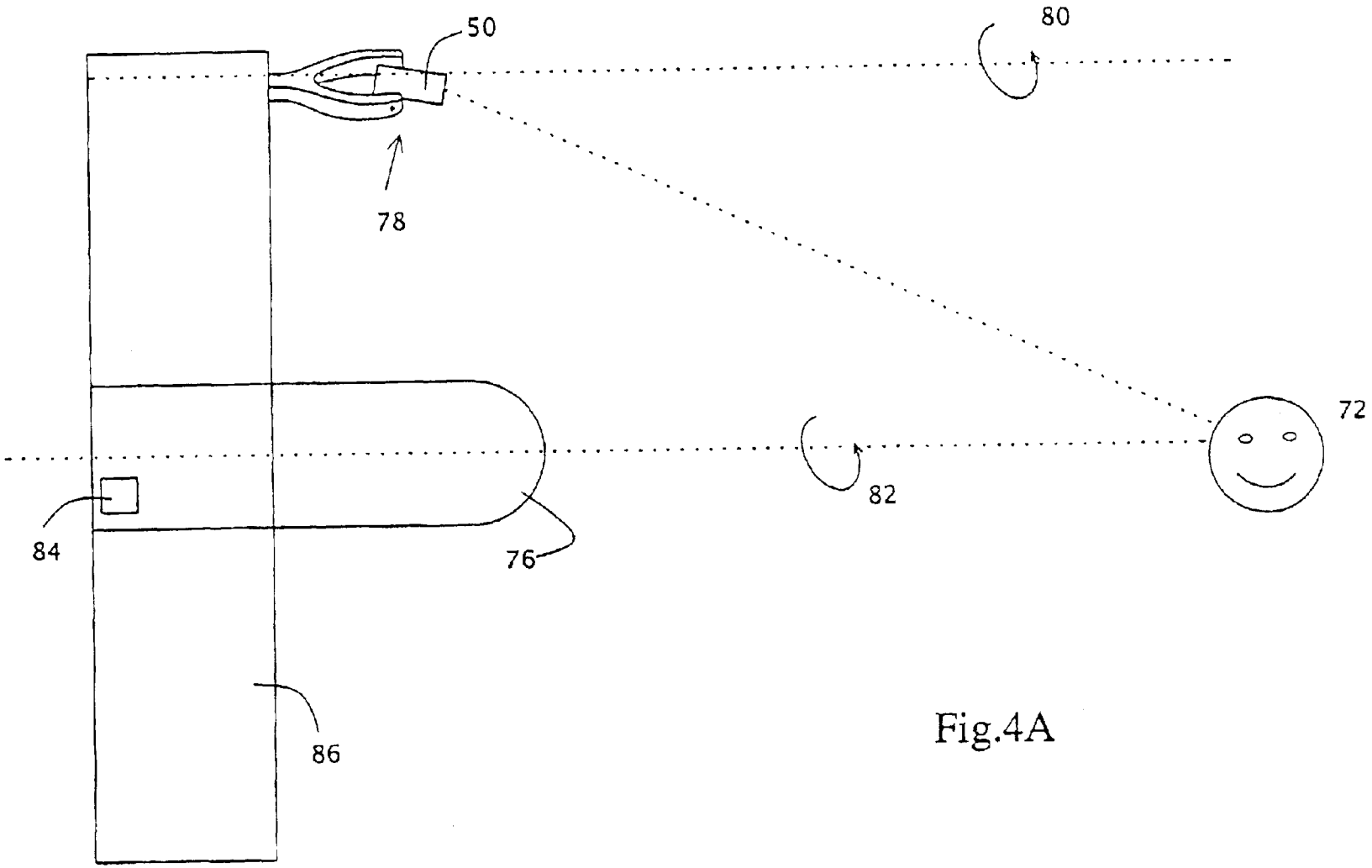
FIGS. 4A–4C are schematic depictions of a gimbal mount according to the method of the present invention where the gimbal roll axis is parallel but 2 meters from the platform roll axis.
Figure 4C:
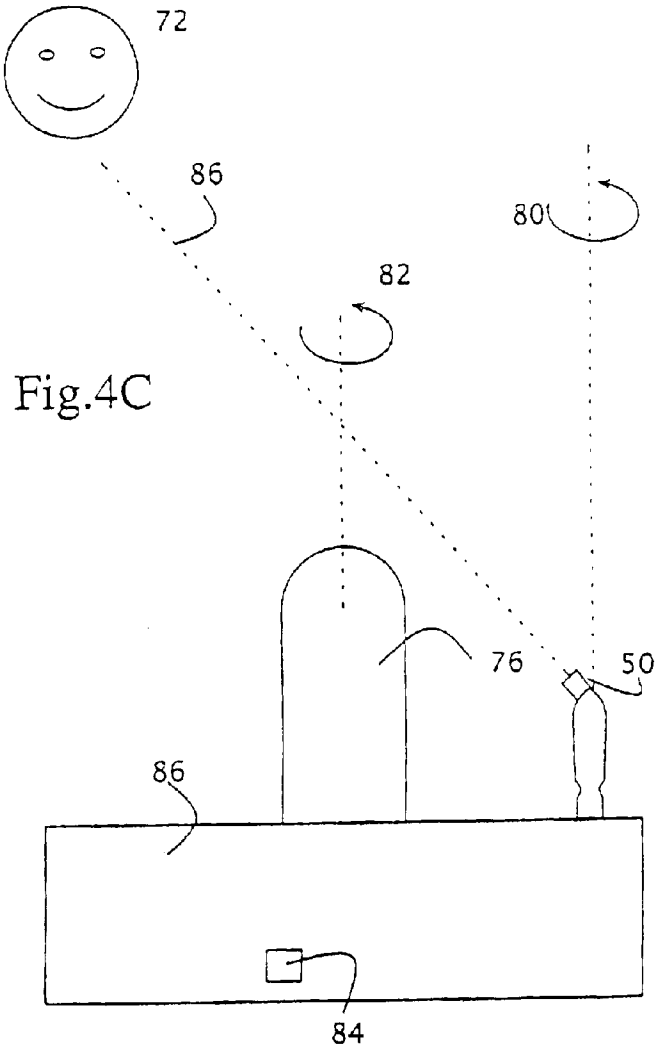
Figure 4B:
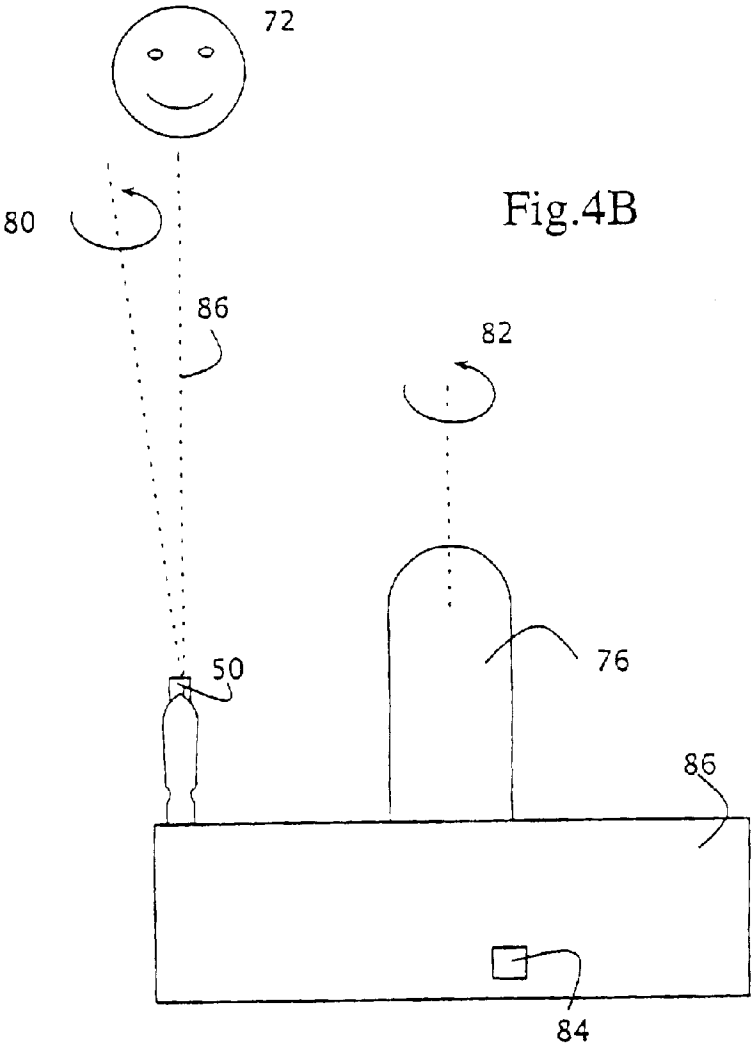

A second embodiment of the present invention is schematically depicted in FIGS. 4A through 4C. A camera 50 is mounted on a platform 76 using gimbal mount 78. Gimbal mount 78 is mounted on platform 76 so that gimbal roll axis 80 is parallel but 2 meters offset from colinearity with platform roll axis 82. Beyond the usual control of camera orientation using the roll and nod axes of gimbal mount 78, control system 84 is also configured to control rotation of platform 76 around platform roll axis 82.

In FIG. 4B, it is necessary to direct camera 50 at moving target 72 in a direction 86 that is close to a gimbal locking situation, e.g. a 0.1° divergence of gimbal roll axis 80 from direction 86. Control system 84 uses aerodynamic surfaces 76 to control rotation of platform 76 around platform roll axis 82.

When platform 76 is rotated 180° around platform roll axis 82 relative to FIG. 4B, FIG. 4C, gimbal locking is avoided. In FIG. 4C, to direct camera 50 at moving target 72 which is 500 meters distant, a divergence of 0.56° divergence of gimbal roll axis 80 from direction 86 is necessary.

As is clear to one skilled in the art, there are four different fashions of implementing the method of the present invention as concerns the relationship between the roll axis of the gimbal mount or beam steering device and the platform roll axis.

In the first fashion, the two axes 64 and 68 are oblique (nonparallel) and intersect in the immediate vicinity of the gimbal mount or beam steering device, as depicted in FIGS. 3A through 3C.

In the second fashion, the two axes 80 and 82 are parallel but not colinear, FIGS. 4A through 4C.

Figure 5:
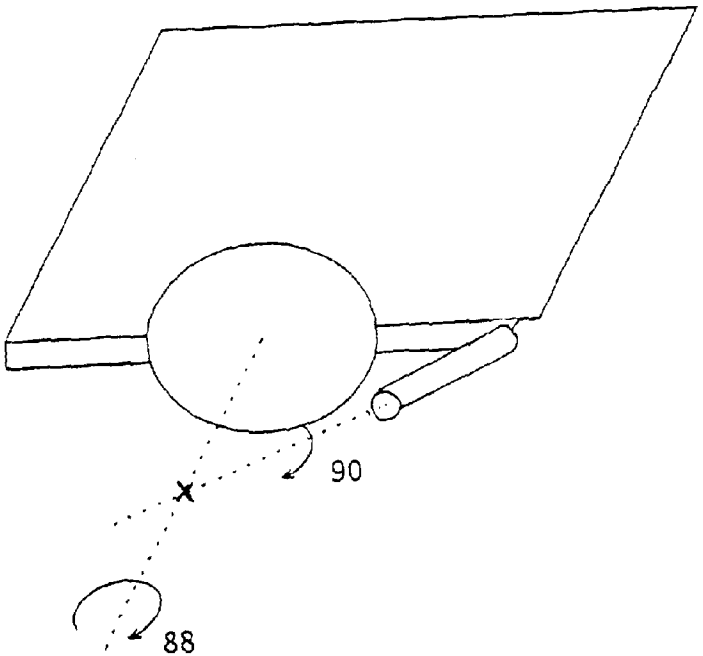
FIG. 5 is a schematic depiction of gimbal mount according to the method of the present invention where the gimbal roll axis is coplanar but not parallel to the platform roll axis, and the axes intersect remotely from the gimbal mount.

In the third fashion, the two axes 88 and 90 are oblique (nonparallel), but intersect distant from the gimbal mount or beam steering device, FIG. 5.

Figure 6:
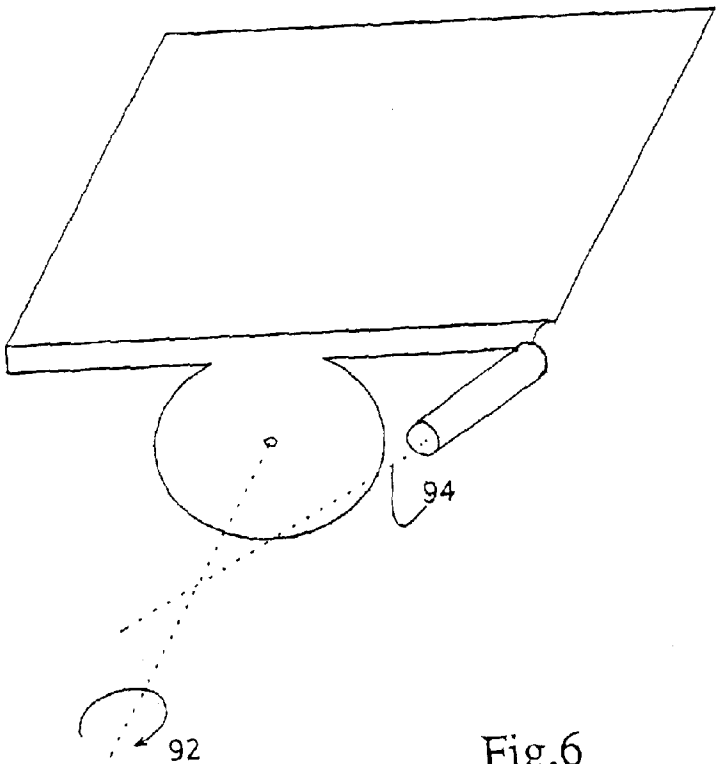
FIG. 6 is a schematic depiction of gimbal mount according to the method of the present invention where the gimbal roll axis is not coplanar with the platform roll axis.

In the fourth fashion, the two axes 92 and 94 are noncoplanar, oblique (nonparallel), and do not intersect at all, FIG. 6.

As is clear to one skilled in the art and as noted hereinabove, the present invention is applicable to a plethora of beam steering devices. Specifically, there exist beam-steering devices that, unlike gimbal mounts that orient a mounted directional device physically, direct only a beam to or from a directional device. Examples include a four-mirror beam steering device or a Risley prism beam steering device. Despite the differences between the various beam-steering devices, perusal of the description of the present invention as herein set forth allows application of the present invention to beam-steering devices other than gimbal-mounts to one of average skill in the art.

Figure 7B:
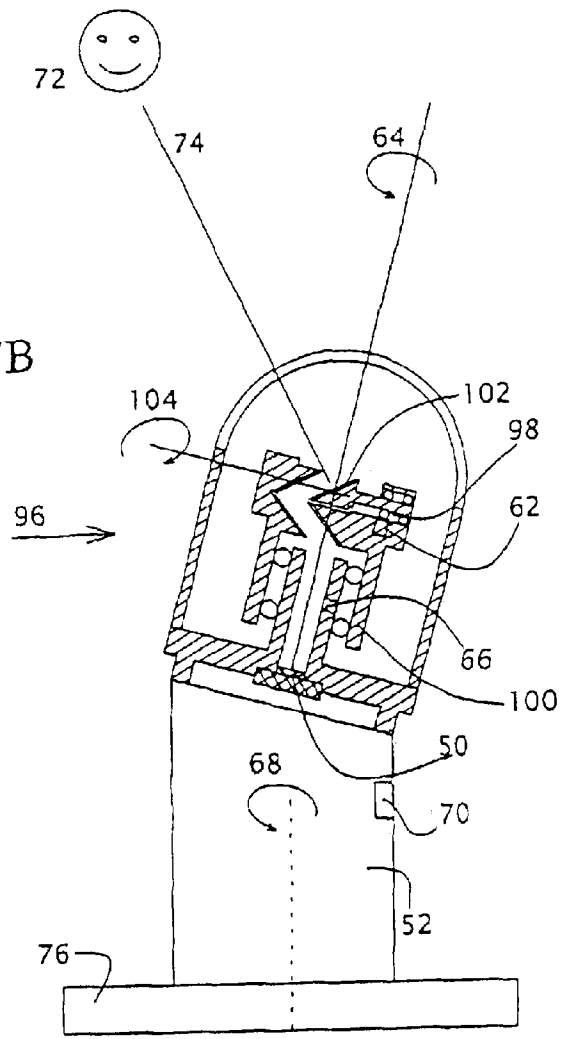
FIGS. 7A–7B is a schematic side view of a four-mirror beam steering device where the beam steering roll axis is 0.5° divergent from the platform roll axis.
Figure 7A:
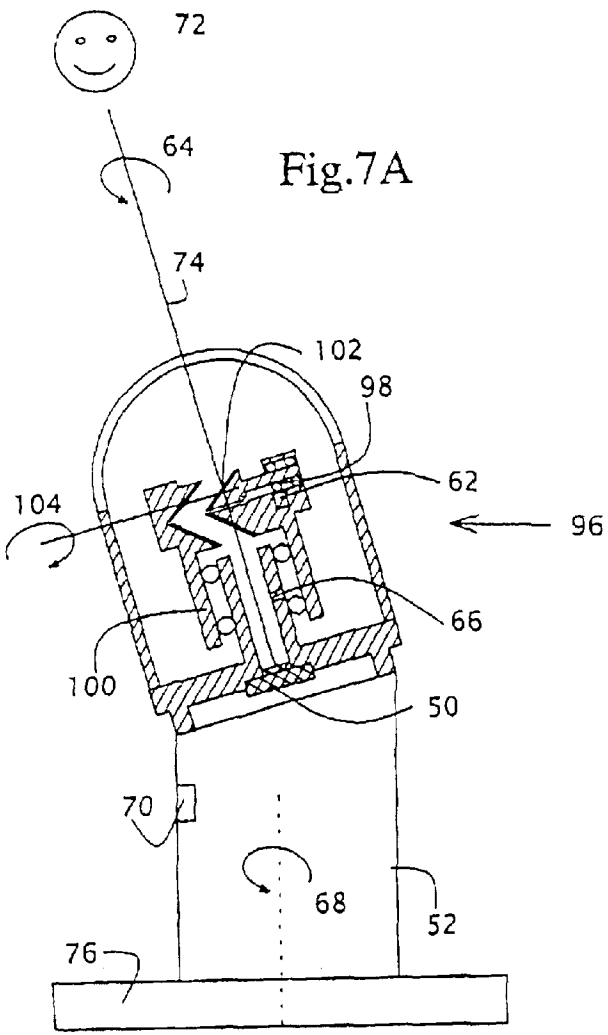

A third embodiment of the present invention is schematically depicted in FIGS. 7A and 7B where beam steering roll axis 64 of a four-mirror beam steering device 96 is 0.5° divergent from platform roll axis 68. The angular divergence of beam steering roll axis 64 from platform roll axis 68 in FIGS. 7A–7B has been exaggerated for illustrational clarity.

Four mirror beam steering device 96 is used to direct light from moving target 72 in direction 74 to camera 50. Four mirror beam steering device 96 has two independently moveable members, nod member 98 and roll member 100 to ensure that light from direction 74 is reflected to camera 50.

Activation of a first motor 62 moves nod member 98 to which mirror 102 is connected, varying beam steering nod axis 104. Activation of second motor 66 allows rotation of roll member 100 around beam steering roll axis 64. Four mirror beam steering device 96 is mounted on platform 52 so that beam steering roll axis 64 is 0.5° divergent from platform roll axis 68. As described hereinabove, control system 70 is configured to activate first motor 62 and second motor 66 so as to direct mirror 102 in a desired direction. Further, control system 70 is also configured to control rotation of platform 52 around platform roll axis 68.

In FIG. 7A, it is necessary to orient mirror 102 so as to reflect light from direction 74 to camera 50, a direction that is close to a gimbal locking situation, e.g. a 0.1° divergence of beam steering roll axis 64 from direction 74. Control system 70 uses aerodynamic surface 76 to rotate platform 52 around platform roll axis 68.

As a result of a 180° rotation around platform roll axis 68 relative to FIG. 7A, FIG. 7B, gimbal locking is avoided. In FIG. 7B, in order to orient mirror 102 in direction 74 so as to reflect light from direction 74 to camera 50, a 1.1° divergence of beam steering roll axis 64 from direction 74 is necessary.

The design parameters of a specific implementation of the present invention and consequently the exact magnitude of divergence from parallel or the physical distance between the roll axis of a gimbal mount or beam steering device and the platform roll axis is clear to one skilled in the art, and is not a salient part of the present invention. It is clear to one skilled in the art, however, that by allowing the avoidance of a gimbal locking situation and the consequent reduced maximal angular velocity requirement, a gimbal mount or beam steering device can be made more compact and more light in weight. Further, tracking accuracy can be improved, as a lightweight mount will allow quick orientation with little momentum effects.

In the examples hereinabove, to avoid a gimbal locking situation, a platform rolled 180° around the platform roll axis. The value of 180° is arbitrary and chosen exclusively for exemplary purposes. As is clear to one skilled in the art, the magnitude of rolling to avoid a gimbal locking situation is dependent on many factors and is not limiting to the scope of the present invention.

The method of the present invention is applicable in any situation when a directional device is mounted on a rollable platform using a gimbal mount or beam steering device. It is clear that most often the directional device mounted is a receiver and/or transmitter of electromagnetic radiation of various frequencies, especially infrared, visible light, ultraviolet, microwave and radio frequencies.

The method of the present invention is applicable in a situation when the platform is rollable under direction of the gimbal mount or beam steering device control system. Thus it is exceptionally suitable for a guided missile, rocket or shell where rolling can be freely performed to orient the directional device or beam without other considerations.

There are many methods to control the rolling of a platform. Most commonly, rolling is controlled either by the use of impulse motors or by the movement and/or deformation of aerodynamic surfaces. The choice of the exact method for controlling platform rolling for any specific application is well within the abilities of one skilled in the art.

It is understood that the specification and examples are illustrative and do not limit the present invention. Other embodiments and variations not described herein understood to be within the scope and spirit of the invention.

What is claimed is:

1. A mount for orienting a directional device mounted on a platform, the platform having a platform roll axis comprising:

a) a gimbal structure for supporting the directional device, said gimbal structure including a gimbal roll axis and a gimbal nod axis, wherein said roll axis is substantially different from the platform roll axis;

b) a first mechanism for changing an orientation of said directional device by rotation around said roll axis;

c) a second mechanism for changing an orientation of said directional device by rotation around said nod axis;

d) a roll-control mechanism for causing rotation of the platform around the platform roll axis; and e) a control mechanism for controlling said first mechanism, said second mechanism and said roll-control mechanism so as to coordinate rotation around said gimbal roll axis, said gimbal nod axis and the platform roll axis.

2. The mount of claim 1 wherein said gimbal roll axis is parallel to the platform roll axis.

3. The mount of claim 1 wherein said gimbal roll axis is oblique to the platform roll axis.

4. The mount of claim 3 wherein said gimbal roll axis and the platform roll axis lack an intersection point.

5. The mount of claim 1 wherein said roll-control mechanism includes at least one reaction motor.

6. The mount of claim 1 wherein said roll-control mechanism includes at least one aerodynamic surface.

7. A device for steering a beam in relation to a directional device mounted on a platform, the platform having a platform roll axis comprising:

a) a beam steering structure for steering the beam, said beam steering structure including a beam steering roll axis and a beam steering nod axis, wherein said beam steering roll axis is substantially different from the platform roll axis;

b) a first mechanism for changing an orientation of the beam around said beam steering roll axis;

c) a second mechanism for changing an orientation of the beam around said beam steering nod axis;

d) a roll-control mechanism for causing rotation of the platform around the platform roll axis; and e) a control mechanism for controlling said first mechanism, said second mechanism and said roll-control mechanism so as to coordinate rotation around said beam steering roll axis, said beam steering nod axis and the platform roll axis.

8. The mount of claim 7 wherein said beam steering roll axis is parallel to the platform roll axis.

9. The mount of claim 7 wherein said beam steering roll axis is oblique to the platform roll axis.

10. The mount of claim 9 wherein said beam steering roll axis and the platform roll axis lack an intersection point.

11. The mount of claim 7 wherein said roll-control mechanism includes at least one reaction motor.

12. The mount of claim 7 wherein said roll-control mechanism includes at least one aerodynamic surface.

13. A method of aiming a directional device, mounted on a platform having a platform roll axis, in a certain direction comprising:

a) providing a structure for aiming the directional device, said structure including a device roll axis and a device nod axis, wherein said device roll axis is substantially different from the platform roll axis;

b) aiming the directional device in the certain direction by changing the aim of the directional device about said device roll axis and about said device nod axis; and c) if as a result of said aiming the directional device in the certain direction said device roll axis approaches coincidence with the certain direction: rotating the platform about the platform roll axis.

14. The method of claim 13 wherein said device roll axis is parallel to the platform roll axis.

15. The method of claim 13 wherein said device roll axis is oblique to the platform roll axis.

16. The method of claim 15 wherein said device roll axis and the platform roll axis lack an intersection point.

* * * * *